United States Patent [19]

Muck

[11] Patent Number: 4,565,488

[45] Date of Patent: Jan. 21, 1986

[54] COMPRESSOR

[75] Inventor: Jack E. Muck, Garfield Heights, Ohio

[73] Assignee: AccuSpray, Inc., Bedford Heights, Ohio

[21] Appl. No.: 544,218

[22] Filed: Oct. 21, 1983

[51] Int. Cl.[4] ..... F01D 5/00

[52] U.S. Cl. ..... 415/53 R; 415/26; 200/81.9 R; 200/83 S

[58] Field of Search ..... 415/1, 53 R, 118, 11, 415/26, 54; 200/83 N, 83 Q, 81.9 R, 83 R, 835, 318, 323, 327; 417/79, 80, 81, 38

[56] References Cited

U.S. PATENT DOCUMENTS

| | | | |
|---|---|---|---|
| 1,414,912 | 5/1922 | Whittingham | 200/83 S |
| 1,574,577 | 2/1926 | Hodgson | 200/83 S |
| 2,071,042 | 2/1937 | Maurer | 200/83 N |
| 2,156,946 | 5/1939 | Closson et al. | 200/318 |
| 2,174,960 | 10/1939 | Barzen | 415/11 |
| 2,680,168 | 6/1954 | Murphy | 200/81.9 R |
| 2,779,352 | 1/1957 | Lung | 417/80 |
| 3,738,776 | 6/1973 | Debare | 417/38 |
| 3,895,885 | 7/1975 | Liberg | 417/80 |
| 3,981,631 | 9/1976 | Kemp | 417/313 X |
| 4,006,083 | 2/1977 | Westervelt et al. | 200/83 N |
| 4,156,578 | 5/1979 | Agar et al. | 415/1 |
| 4,230,437 | 10/1980 | Bellinger et al. | 415/1 |
| 4,401,413 | 8/1983 | Dickens | 417/38 |
| 4,464,720 | 8/1984 | Agarwal | 415/11 |

FOREIGN PATENT DOCUMENTS

| | | | |
|---|---|---|---|
| 893320 | 6/1944 | France | 415/11 |
| 559108 | 2/1944 | United Kingdom | 417/79 |

*Primary Examiner*—Edward K. Look
*Assistant Examiner*—John Kwon
*Attorney, Agent, or Firm*—Sidney W. Millard

[57] ABSTRACT

A method for protecting a compressor by reducing the differential pressure from the inlet to the outlet of the compressor by turbo-charging the inlet plenum of the compressor to reduce the normally present vacuum condition in the inlet, vacuum being simply a sub-ambient pressure. However, the inlet plenum is not increased to a pressure above ambient. Additionally by preventing a high vacuum condition from existing at the inlet plenum of the compressor by warning or even stopping the compressor if the vacuum reaches too great a level.

19 Claims, 3 Drawing Figures

COMPRESSOR

FIELD OF THE INVENTION

The invention relates to a method for protecting a compressor, and more particularly relates to a method of minimizing the effects of vacuum at the inlet of a relatively high volume low pressure compressor.

BACKGROUND OF THE INVENTION

Compressors and more specifically centrifugal compressors, which are utilized as for example in providing the atomizing air to a spray painting system have a filtered inlet air supply. The ambient air from the room, which enters the inlet plenum of the compressor, is filtered by a relatively low pressure drop filter of the replaceable type. A filter is necessary for the protection of the internals of the compressor from damage due to dirt and particles that are present in the ambient air drawn into the inlet plenum and compressor assembly. These particles of dirt and foreign matter, instead of damaging the internals of the compressor, tend to plug the filter. In time, the differential pressure across the filter increases and the compressor is required to work harder in order to draw the required amount of air through the filter and into the inlet plenum. This occurs because a centrifugal compressor is inherently a constant mass machine, meaning that the mass flow rate of air (pounds per minute) remains constant in most operating conditions. Therefore, the compressor must generate the differential pressure required to draw the constant mass of air into its inlet plenum. This compensating action of the compressor itself leads to a very low, subatmospheric, pressure in the inlet plenum when the ambient air being drawn through the filter is at atmospheric pressure. Such a low pressure in the inlet plenum, when compared to the relatively higher pressure at the last stage of the compressor at the outlet, means that there is a constant force on the internals of the compressor acting from the inlet toward the outlet causing flexure of the successive stages of the centrifugal compressor. Such flexure causes increased wear on the internals of the compressor leading to the potential for failure of the compressor due to mechanical fatigue of the materials of the construction.

Additionally, it may be noted that such a differential pressure between the inlet plenum and the outlet plenum occurs even if there is no filter present or the filter is always changed in a timely manner. The results of even the normal differential pressure across the turbine internals leads to some material fatigue, but additionally leads to the use or input of more energy at the compressor motor than would be required if the differential pressure from inlet to outlet were even further reduced. Since the reduction of the outlet pressure is an undesirable solution to the problem, it would be most desirable to moderately increase the pressure at the inlet plenum without any corresponding changes in the outlet pressure thereby achieving a lower differential pressure from the inlet plenum to the outlet plenum of the compressor and thereby conserving energy.

Therefore, there is a need for a method of protecting a compressor from undue differential pressures from the inlet plenum to the outlet plenum, especially those higher differential pressures caused by a dirty filter. Additionally, there is a need for a method of altering the pressure at the inlet plenum to produce a corresponding reduction in the energy input to the compressor that is required to maintain a constant outlet pressure at a constant mass flow.

SUMMARY OF THE INVENTION

A method for increasing the inlet pressure on a compressor by providing that a portion of the compressed gas from the output of the compressor is diverted to an eductor. The eductor then educts low pressure gas from the ambient gas source for the compressor toward the inlet plenum of the compressor. In this manner the pressure that resides in the inlet plenum of the compressor will be increased from its level below ambient pressure to a relatively higher pressure although even this higher pressure will also be below the ambient pressure of the source of the gas for the compressor.

Another aspect of the present invention provides for protecting the compressor from unduly low pressures at its inlet plenum by means of a vacuum operated electrical contactor. The vacuum operated electrical contactor is opened by a pressure below ambient pressure which is also below an adjustable set point. Once the contactor has been opened due to the low pressure conditions, the contacts will be maintained in the open position even after the low pressure condition has been eliminated. The method provides for manually resetting the vacuum operated electrical contactor as a positive safety feature.

BRIEF DESCRIPTION OF THE DRAWINGS

These and other aspects of the invention will become better understood by reference to the following detailed description which, when considered in conjunction with the accompanying drawings, will reveal the best mode contemplated in carrying out this invention.

DESCRIPTION OF THE PREFERRED EMBODIMENT

Figure 1:
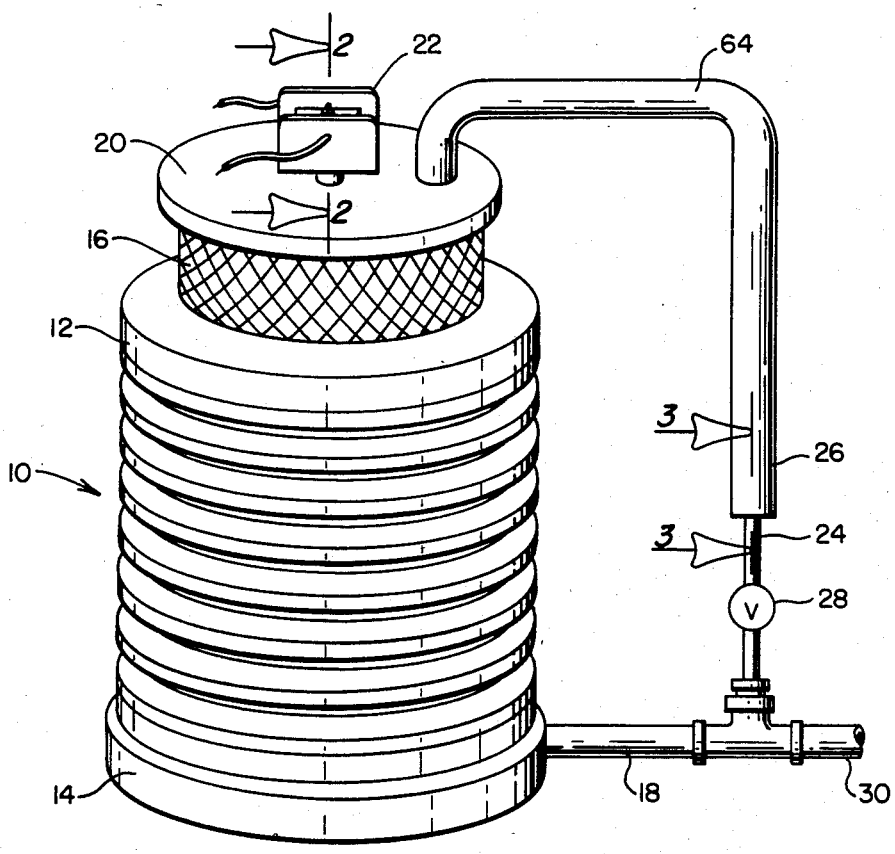
FIG. 1 is a perspective view of a compressor having an eductor and vacuum operated electrical contactor in accordance with the present invention.

With reference to the figures, in FIG. 1 a compressor 10, preferably a multistaged centrifugal compressor, having inlet stage 12 and outlet stage 14 is shown. Ambient air is drawn into the inlet plenum through air filter 16 and discharged through discharge pipe 18 for use in a process or as further described below.

In a relatively dirty atmospheric environment, such as that encountered in a commercial painting facility, the use of an inlet plenum air filter is an absolute necessity since dirt and foreign matter can cause extensive damage to the internals of a centrifugal compressor. Centrifugal compressors inherently have very closely toleranced moving parts upon which the action of foreign materials and particles can have an immediate and disastrous effect.

The configuration according to the present invention shown in FIG. 1 has modified the inlet plenum by utilizing inlet plate 20 upon which is mounted a vacuum operated electrical contactor or pressure actuated switch 22 which is described in more detail below. Additionally shown in FIG. 1 is recirculation line 24 which is the high energy portion of eductor 26. The flow to recirculation line 24 is regulated by valve 28, the remaining pressurized air from outlet stage 14 and discharge pipe 18 being transmitted to the compressed air load via load pipe 30.

Figure 2:
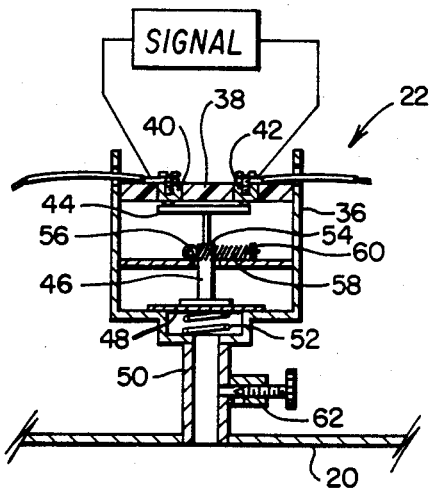
FIG. 2 is an elevational cross section of the vacuum operated electrical contactor of FIG. 1 taken along line 2—2.

Turning now in more detail to the vacuum operated electrical contactor 22, according to the present invention, which is shown more clearly in FIG. 2, a housing 36 supports a non-conducting electrical plate 38 which supports electrical lugs 40 and 42. The electrical lugs 40 and 42 are electrically connected by contactor bar 44 which is moveably attached to diaphragm operated connector 46 which is moved by diaphragm 48. Diaphragm 48, preferably an elastomeric material, moves in accordance with the vacuum which resides below it. That vacuum originates in the inlet plenum of the compressor immediately below inlet plate 20 and is in fluid communication with diaphragm 48 via vacuum sense line 50 which extends through inlet plate 20. Additionally the diaphragm is retained in its normal undeflected position by spring 52, spring 52 having an appropriate tension to prevent the contacts from being inadvertently opened by the contactor bar 44 being vibrated loose from electrical contact with lugs 40 and 42. This is necessary because of the vibration inherently attendant to compressor operation.

Further, diaphragm operated connector 46 includes a shoulder 54 which provides a resting place for manual reset lever 56. Manual reset lever 56 is spring operated by reset spring 58, reset spring 58 being maintained in tension by pin 60.

The normally existing vacuum condition which exists below plate 20 is transmitted to the vacuum operated electrical contactor through vacuum sense line 50. If that vacuum increases sufficiently (reduction in absolute pressure) to overcome the tension in spring 52, diaphragm 48 will deflect in a downward direction toward the vacuum source thereby moving contact bar 44 downward and breaking electrical contact with electrical lugs 42 and 44. Manual reset lever 56 which normally resides below shoulder 54, engages the shoulder when diaphragm operated connector 46 is moved in a downward direction. When manual reset lever 56 engages the top of the shoulder it thereby prevents spring 52 from moving the diaphragm 48 and reseating contactor bar 44. In this way, it is necessary for the operator to manually reset the vacuum operated electrical contactor after a high vacuum condition is encountered. Normally the high vacuum condition would be encountered by the plugging of air filter 16. Therefore, replacement of air filter 16 would be the immediate maintenance action that would normally be required, this evolution being necessary prior to resetting the compressor thereby preventing undue damage to the internals of the compressor due to a high differential pressure existing between the inlet stage and the outlet stage of the compressor.

Additionally shown in FIG. 2 is vacuum set point valve 62 which is preferably a leaking type needle valve which allows the vacuum set point at which the diaphragm will be actuated to be adjusted independent of the vacuum existing below inlet plate 20. Additionally set point valve 62 allows for establishment of the vacuum set point of the vacuum operated electrical contactor in conjunction with tensioning spring 52. It will be appreciated that additional vacuum set point adjustment means may be utilized with equal effect, as for example, a two sided bellows operated type set point device or other means.

Additionally it will be appreciated that electrical lugs 40 and 42 may be connected to either the power to the compressor itself or may activate a relay which controls the power supply to the compressor. Additionally the electrical lugs 40 and 42 may represent a point in a circuit simply lighting a control or warning light or sounding an audible warning device if the immediate shutdown of the compressor is deemed undesirable by the designers.

Figure 3:
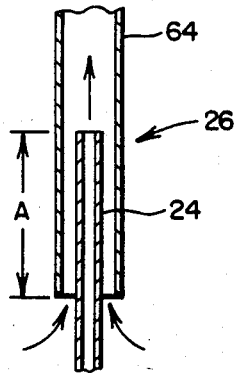
FIG. 3 is a cross section taken along line 3—3 of FIG. 1 showing the eductor.

Turning now to FIG. 3 which is a detail cross section of eductor 26 according to the present invention showing recirculation line 24 penetrating a distance A into eductor pipe 64. The momentum of the high energy air traveling within recirculation line 24 creates a low pressure condition at the inlet annulus of eductor pipe 64 thereby drawing ambient air into the eductor pipe 64 for deposition into the inlet plenum of the compressor 10.

The eductor operated recirculation system shown is a recirculation system wherein the high energy compressible gas is partially throttled within the eductor, thereby utilizing the energy of the throttling action to turbocharge the inlet plenum of the compressor 10. Normally in a recirculation system, the throttled energy is lost from the system whereas in the system according to the present invention, it is retained and utilized to the greatest extent possible. It will be appreciated that not all of the energy of the compressed air passing through recirculation line 24 will be expended in the throttling action or even in the pressure drop of travel through eductor pipe 64 back to the inlet plenum. It is necessary to maintain some of the energy of the compressed air in order to increase the pressure at the inlet plenum at a higher level.

It will be understood by those familiar with the art of centrifugal compressors that the pressure in the inlet plenum of such a compressor is normally below ambient pressure. This means that there is an inherent differential pressure from the inlet plenum to the outlet stage of a centrifugal compressor of the multistage variety. The turbo-charging of the present invention acts to increase the pressure in the inlet plenum thereby reducing the differential pressure across the compressor. It is necessary to adjust distance A and the amount of recirculated air passing through valve 28 into recirculation line 24 in order that (1) the proper amount of air is drawn into the inlet plenum and (2) the pressure in the inlet plenum is maintained at a pressure below ambient yet higher than the inlet plenum pressures achievable without the use of the turbo-charging eductor.

A centrifugal compressor operating at constant speed is essentially a constant output pressure device operating at a fixed mass flow rate. Therefore, the act of increasing the pressure at the inlet plenum has very little affect in increasing the pressure at the outlet stage. However, because less work will be required of the compressor because of the decreased pressure differential across the compressor, there will be a net energy savings in the amount of energy drawn by the compressor motor to compress a given mass of air. In this way the energy conserved by throttling the recirculation compressed air in an eductor system is recognized at the compressor motor. Additionally, it will be appreciated that the amount of recirculation air that can be utilized is subject to limitations on increasing the inlet temperature and thereby increasing the temperature of the internals of the compressor. This is a minor problem due to the thermodynamically irreversible throttling of the recirculated air as it dumps from smaller diameter recirculation line 24 into the larger annularly disposed eductor pipe 64 within inherent Joule-Thompson type cooling being caused.

It will be apparent from the above description that the present invention provides a method of improving the operation of a centrifugal compressor by means of reducing the differential pressure from the inlet stage to the outlet stage of said compressor. The method provides for preventing undue blockage and therefore high vacuum at the inlet due to a plugged filter by warning the operator of such a condition through an automatic vacuum operated electrical contactor. The method additionally provides for relatively increasing the pressure (i.e. reducing the vacuum) in the inlet plenum thereby reducing the differential pressure across the compressor.

Having thus described this invention, what is claimed is:

1. A method for protecting a high volume electrically powered compressor from excessive internal pressure differentials which are caused by a partially blocked air filter adjacent the compressor inlet comprising the steps of:

providing an air compressor having an inlet, a filter adjacent said inlet, and an outlet, drawing air through said filter and then into the inlet, compressing it and discharging it through the outlet, disposing a vacuum operated electrical contactor in fluid communication with the inlet of the compressor, said fluid communication being only at a position such that the air at said position has already passed said filter, said contactor being spring loaded to the closed position to allow electricity to flow to said compressor, decreasing the pressure at the position an amount sufficient to overcome the force exerted by the spring, thereby opening said contactor and stopping the flow of electricity to said compressor, and locking said contactor in open position.

2. The method according to claim 1 wherein said electrical contactor operates a signal when opened.

3. The method according to claim 1 wherein said electrical contactor disconnects the power to said compressor when opened.

4. The method according to claim 1 wherein said electrical contactor is opened by a diaphragm operated actuator.

5. An apparatus for stopping an electrically powered air compressor upon the partial blocking of an air filter adjacent the air inlet to said compressor, said apparatus including a compressor having an inlet, an outlet and a pressure actuated switch for stopping the flow of electricity to the compressor, an air filter mounted adjacent said inlet to filter air prior to the air entering said inlet, said switch being in fluid communication with the compressor near the inlet and downstream of the filter, two spaced apart electrical terminals on said switch, a bar of electrically conductive material extending across the space between the terminals to conduct electricity to said compressor, said bar being connected to a diaphragm, said diaphragm sealing the path of fluid communication between the compressor and the switch, means biasing the bar toward the terminals and means for locking the bar out of contact with said terminals upon the pressure actuated withdrawal of said bar from said contact by said diaphragm.

6. The apparatus of claim 5 including means for signaling when the pressure of the air in fluid communication with the switch reaches a predetermined level, means for adjusting the pressure at which the signaling means is activated.

7. The apparatus of claim 6 including means for adjusting the pressure differential between the filter and the outlet.

8. The apparatus of claim 7 wherein the pressure differential adjusting means includes means for delivering a portion of the air from the outlet into the compressor downstream of the filter.

9. The apparatus of claim 8 wherein said portion of the air from the outlet passes sequentially from a small diameter line to a larger diameter line and then to said compressor, said smaller diameter line being inserted a given distance into said larger diameter line, the diameter differential of said lines allowing air flowing from the smaller diameter line into the larger diameter line to draw air from the atmosphere into the larger diameter line through the annulus formed by the overlapping ends of the two lines.

10. The apparatus of claim 5 including means for adjusting the pressure differential between the inlet and the outlet.

11. The apparatus of claim 10 wherein the pressure differential adjusting means includes means for delivering a portion of the air from the outlet into the compressor downstream of the filter.

12. The apparatus of claim 6 wherein the pressure differential adjusting means includes means for delivering a portion of the air from the outlet into the inlet.

13. The apparatus of claim 12 wherein a portion of the air from the outlet passes sequentially from a small diameter line to a larger diameter line and then to said compressor said smaller diameter line being inserted a given distance into said larger diameter line, the diameter differential of said lines allowing air flowing from the smaller diameter line into the larger diameter line to draw air from the atmosphere into the larger diameter line through the annulus formed by the overlapping ends of the last two lines.

14. The apparatus of claim 5 wherein the pressure differential adjusting means includes means for delivering a portion of the air from the outlet into the inlet downstream of the filter.

15. The apparatus of claim 14 wherein said portion of the air from the outlet passes sequentially from a small diameter line to a larger diameter line and then to said compressor, said smaller diameter line being inserted a given distance into said larger diameter line, the diameter differential of said lines allowing air flowing from the smaller diameter line into the larger diameter line to draw air from the atmosphere into the larger diameter line through the annulus formed by the overlapping ends of the two lines.

16. The apparatus of claim 5 wherein the means for locking comprises a spring biased locking bar for engaging a shoulder on a part of the bar of electrically conducting material.

17. The apparatus of claim 7 wherein the means for locking comprises a spring biased locking bar for engaging a shoulder on a part of the bar of electrically conducting material.

18. The apparatus of claim 8 wherein the means for locking comprises a spring biased locking bar for engaging a shoulder on a part of the bar of electrically conducting material.

19. The apparatus of claim 9 wherein the means for locking comprises a spring biased locking bar for engaging a shoulder on a part of the bar of electrically conducting material.

* * * * *